US009031473B2

(12) United States Patent
Kitagawa

(10) Patent No.: US 9,031,473 B2
(45) Date of Patent: May 12, 2015

(54) IMAGE FORMING APPARATUS WITH INTERLOCKED MOVEMENT OF ON/OFF OPERATING MEMBER AND SHUTTER FOR TONER CONTAINER

(71) Applicant: KYOCERA Document Solutions Inc., Osaka-shi, Osaka (JP)

(72) Inventor: Hiroaki Kitagawa, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/261,786

(22) Filed: Apr. 25, 2014

(65) Prior Publication Data

US 2014/0321884 A1 Oct. 30, 2014

(30) Foreign Application Priority Data

Apr. 25, 2013 (JP) ..... 2013-092616

(51) Int. Cl.

*G03G 15/08* (2006.01)
*G03G 15/00* (2006.01)
*G03G 21/16* (2006.01)

(52) U.S. Cl.

CPC ..... *G03G 15/0865* (2013.01); *G03G 15/80* (2013.01); *G03G 21/1633* (2013.01); *G03G 2221/1654* (2013.01)

(58) Field of Classification Search

CPC ..... G03G 15/5004; G03G 15/80; G03G 2215/00978; G03G 15/0865; G03G 21/1633; G03G 2221/1654

USPC ..... 399/258, 88, 90, 120, 260

See application file for complete search history.

(56) References Cited

U.S. PATENT DOCUMENTS

| | | | | |
|---|---|---|---|---|
| 5,708,922 | A * | 1/1998 | Azuma et al. | 399/111 |
| 2004/0105695 | A1* | 6/2004 | Seo | 399/90 |
| 2009/0060570 | A1 | 3/2009 | Mizuno et al. | |
| 2011/0052266 | A1* | 3/2011 | Yoon et al. | 399/258 |
| 2011/0280608 | A1* | 11/2011 | Amemiya et al. | 399/88 |
| 2012/0045716 | A1* | 2/2012 | Imamura | 430/105 |
| 2014/0056598 | A1* | 2/2014 | Uohashi | 399/9 |

FOREIGN PATENT DOCUMENTS

JP 2009-58711 3/2009

* cited by examiner

*Primary Examiner* — Rodney Bonnette

(74) *Attorney, Agent, or Firm* — Gerald E. Hespos; Michael J. Porco; Matthew T. Hespos

(57) ABSTRACT

Provided is an image forming apparatus including an apparatus main body, an operation member, a toner container, a shutter, and an interlocking mechanism. The operation member is a member for turning on and off a power supply of the apparatus main body, and takes an ON posture and an OFF posture. The toner container is a container configured to store the toner and including an opening section configured to allow communication between the inside and the outside of the container. The shutter can take an opening posture for opening the opening section and a closing posture for closing the opening section. The interlocking mechanism interlocks the posture of the operation member and the posture of the shutter to set the shutter in the opening posture when the operation member takes the ON posture and to set the shutter in the closing posture when the operation member takes the OFF posture.

7 Claims, 7 Drawing Sheets

IMAGE FORMING APPARATUS WITH INTERLOCKED MOVEMENT OF ON/OFF OPERATING MEMBER AND SHUTTER FOR TONER CONTAINER

CROSS REFERENCE TO RELATED APPLICATION

This application is based upon and claims the benefit from priority of Japanese Patent Application No. 2013-092616 filed on Apr. 25, 2013, the entire contents of which are incorporated herein by reference.

BACKGROUND

The present disclosure relates to an image forming apparatus that forms an image on a sheet using toner.

An image forming apparatus of an electrophotographic system is known that includes an image bearing member, a developing device configured to visualize an electrostatic latent image on the image bearing member to form a toner image; and a cleaning device configured to collect toner remaining on the image bearing member after transfer of the toner image. The image forming apparatus of the electro photographic system includes a toner container configured to store waste toner collected by the cleaning device. The toner container is detachably attachable to the image forming apparatus.

In a technique for preventing the waste toner from spilling from the toner detached from the image forming apparatus, the image forming apparatus includes a shutter configured to close an opening section of the toner container. When the toner container is attached to the image forming apparatus, the shutter opens to make it possible to store the waste toner in the toner container.

However, according to the technique, the shutter is open in a state in which the toner container is attached to the image forming apparatus. Therefore, when the image forming apparatus is transported or moved in that state, the waste toner leaks from the toner container and scatters in the image forming apparatus because of vibrations and shocks during the transportation or the movement.

It is an object of the present disclosure to provide an image forming apparatus that can reduce the toner leakage from the toner container during the transportation of the image forming apparatus.

SUMMARY

An image forming apparatus according to an aspect of the present disclosure includes an apparatus main body, an operation member, a toner container, a shutter, and an interlocking mechanism.

The apparatus main body forms an image on a sheet using toner. The operation member is a member for turning on and off a power supply of the apparatus main body according to operation by a user. The operation member can take an ON posture for turning on the power supply and an OFF posture for turning off the power supply. The toner container is a container configured to store the toner. The toner container includes an opening section configured to allow communication between the inside and the outside of the container. The shutter can take an opening posture for opening the opening section and a closing posture for closing the opening section. The interlocking mechanism interlocks the posture of the operation member and the posture of the shutter to set the shutter in the opening posture when the operation member takes the ON posture and to set the shutter in the closing posture when the operation member takes the OFF posture.

DETAILED DESCRIPTION

Figure 1:
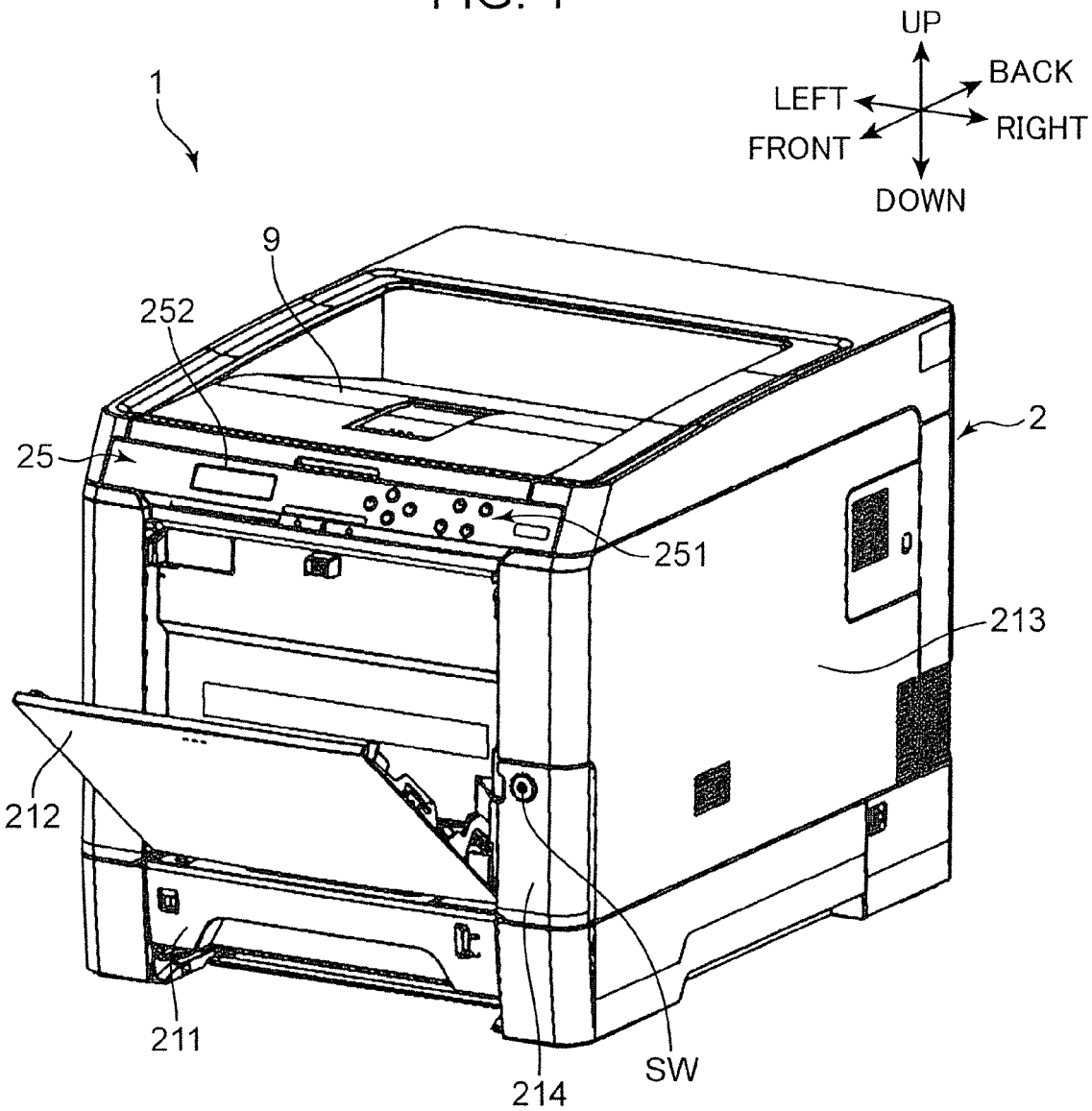
FIG. 1 is a perspective view showing an external appearance of an image forming apparatus according to an embodiment of the present disclosure.

An embodiment of the present disclosure is explained in detail below with reference to the drawings. FIG. 1 is a perspective view showing an external appearance of an image forming apparatus 1 according to an embodiment of the present disclosure. A printer is illustrated as the image forming apparatus 1. However, the image forming apparatus 1 may be a multifunction peripheral.

The image forming apparatus 1 includes an apparatus main body 2. The apparatus main body 2 forms an image on a sheet using toner. Various devices for image formation are housed in the apparatus main body 2. A discharge tray 9 is formed on the upper surface of the apparatus main body 2.

An operation panel 25 is provided on the upper front surface of the apparatus main body 2. The operation panel 25 includes operation keys 251 and an LCD touch panel 252.

A paper feeding cassette 211 is mounted on a lower part of the apparatus main body 2. A maintenance door 212 for exposing the inside of the apparatus main body 2 is attached to the front surface of the apparatus main body 2 and above the paper feeding cassette 211.

A power button SW (an operation member) for turning on and off a power supply is disposed near the center in the up down direction on the front surface at the right end portion of the apparatus main body 2. The power button SW can take, according to pressing operation by a user, an ON posture for turning on the power supply and an OFF posture for turning off the power supply. The power button SW is a push button that slides backward (in a first direction) from an OFF position corresponding to the OFF posture to an ON position corresponding to the ON posture according to the pressing operation by the user.

A right cover 213 is attached to the right side surface of the apparatus main body 2. A toner container cover 214 extending downward from the disposing position of the power button SW is attached to the right side of the maintenance door 212. The toner container cover 214 is pivotably attached to the apparatus main body 2 at the right end edge of the toner container cover 214 and is capable of opening and closing. An opening section for exposing the power button SW is formed in the toner container cover 214. Consequently, the power button SW is exposed in a state in which the toner container cover 214 is closed. In a state in which the toner container cover 214 is opened, a toner container 21 (FIG. 2) is exposed. Consequently, the user can attach and detach the toner container 21 when the toner container cover 214 is in the open state.

Figure 2:
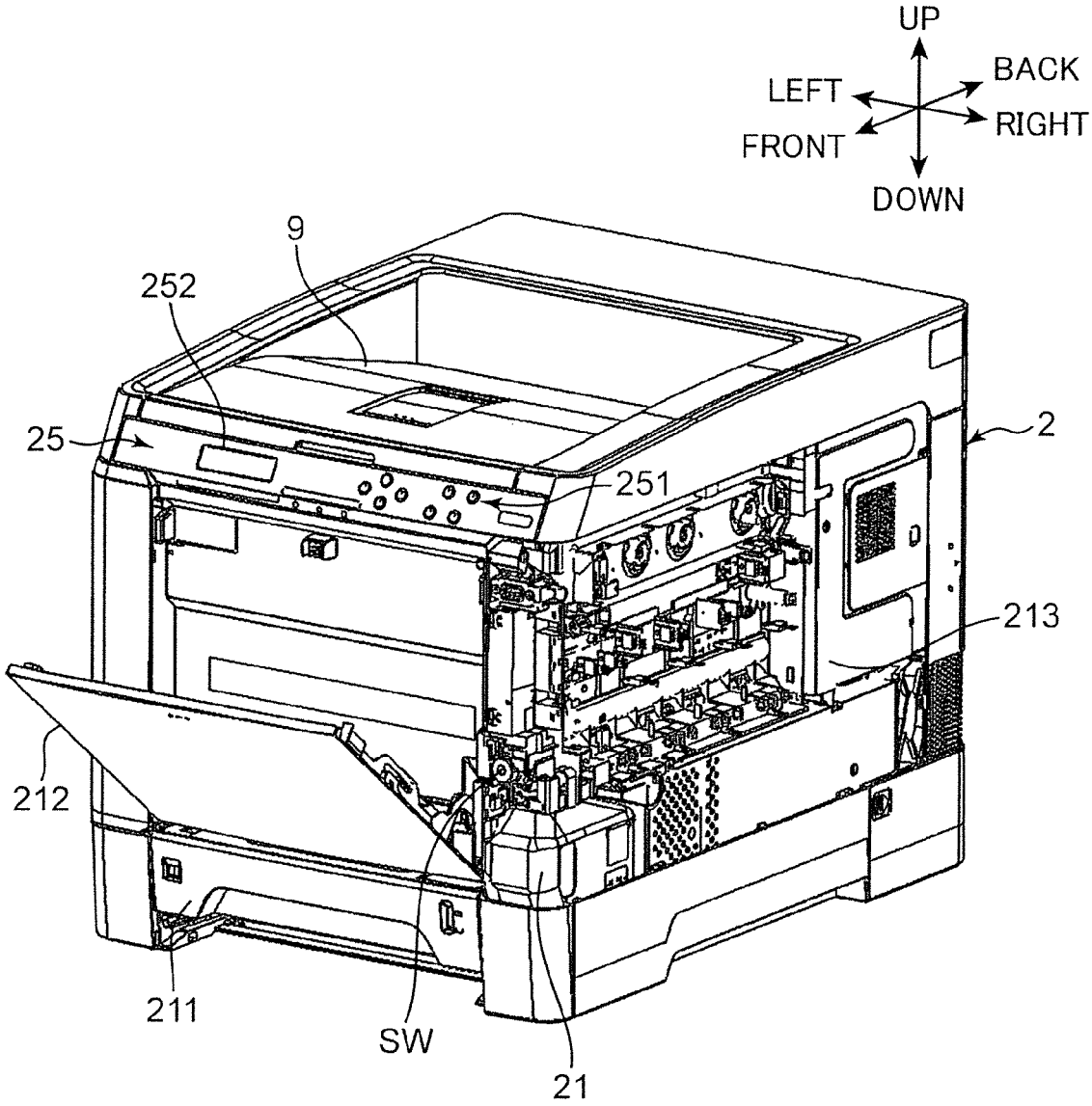
FIG. 2 is a perspective view showing an external appearance of the image forming apparatus in a state in which a right cover and a toner container cover are detached from an apparatus main body shown in FIG. 1.
Figure 3:
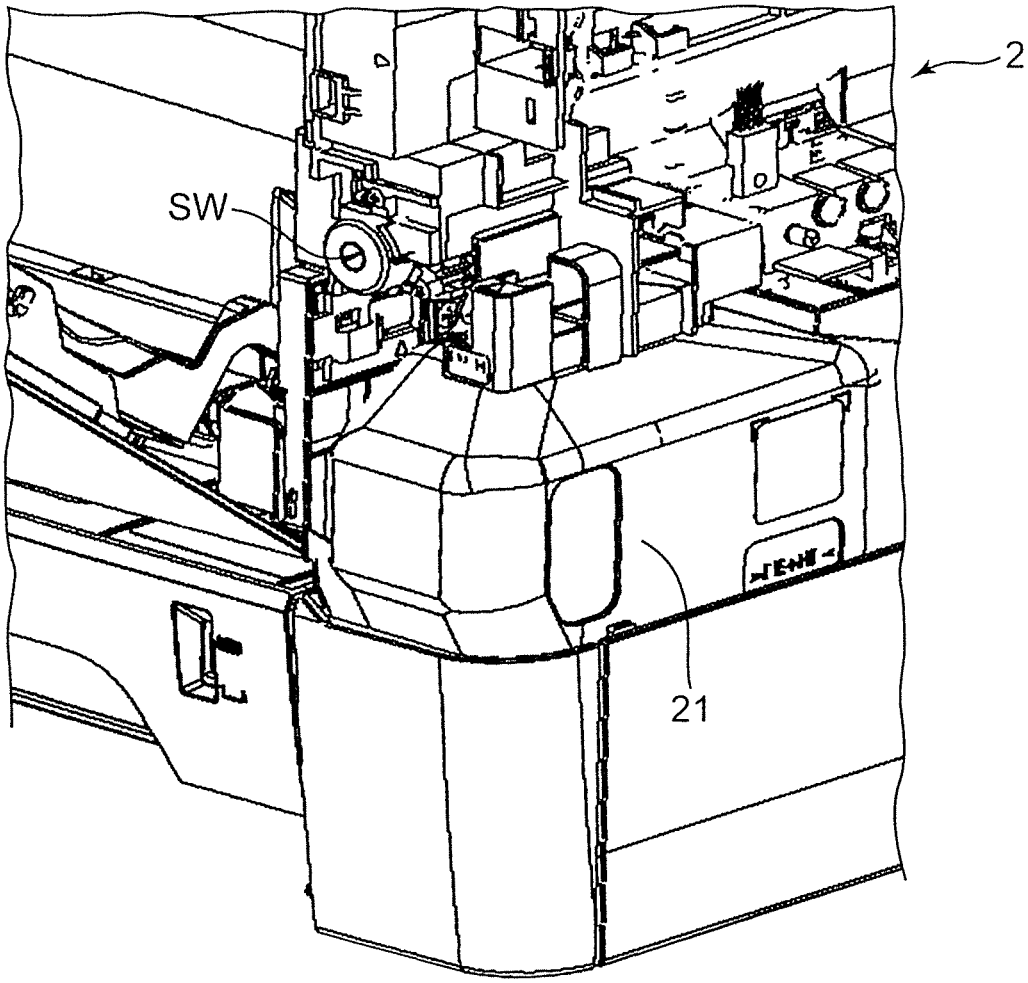
FIG. 3 is an enlarged view of the vicinity of a power button of the image forming apparatus shown in FIG. 2.

FIG. 2 is a perspective view showing an external appearance of the image forming apparatus 1 in a state in which the right cover 213 and the toner container cover 214 are detached from the apparatus main body 2. FIG. 3 is an enlarged view of the vicinity of the power button of the image forming apparatus 1. The toner container 21 configured to store waste toner collected by a cleaning device is disposed below the power button SW. An opening section 210 (FIGS. 7A and 7B) configured to allow communication between the inside and the outside of the toner container 21 is formed above the toner container 21. The user can attach and detach the toner container 21 to the apparatus main body 2 in a state in which the toner container cover 214 is opened.

Figure 4:
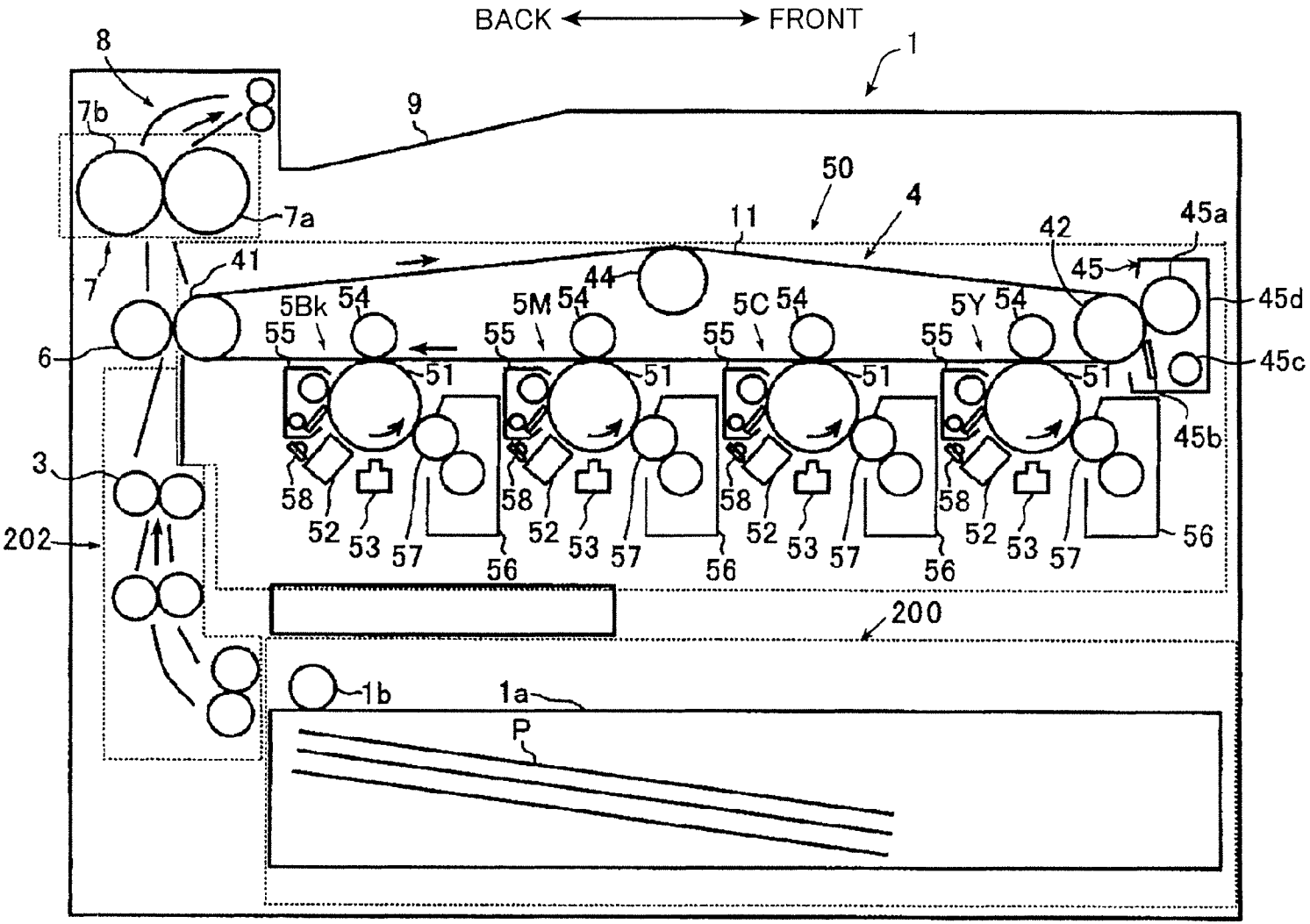
FIG. 4 is a schematic vertical sectional view showing the schematic structure of the image forming apparatus.

FIG. 4 is a schematic vertical sectional view showing the schematic structure of the image forming apparatus 1.

The image forming apparatus 1 is a so-called tandem color image forming apparatus. The image forming apparatus 1 includes a paper feeding section 200, a vertical conveying path 202, a registration roller pair 3, a belt conveying section 4, an image forming section 50, a secondary transfer section 6, a fixing section 7, a discharge conveying path 8, and a discharge tray 9. In the image forming section 50, image forming units 5Bk, 5M, 5C, and 5Y (hereinafter collectively referred to as "image forming units 5") are provided side by side respectively for colors of black (Bk), magenta (M), cyan (C), and yellow (Y) in the apparatus main body 2.

The image forming apparatus 1 performs an image forming process explained below. A sheet P is conveyed from a paper feeding cassette la of the paper feeding section 200 to the vertical conveying path 202 by a pickup roller lb and conveyed to the secondary transfer section 6 via a registration roller pair 3.

In the image forming section 50, an intermediate transfer belt 11 is moved in an arrow direction by a driving roller 41. Toner images of the colors of yellow, cyan, magenta, and black formed on respective photosensitive drums 51 in the image forming units 5Y, 5C, 5M, and 5Bk are sequentially transferred in a superimposed manner onto the intermediate transfer belt 11 and a color image is formed. The formed color image is secondarily transferred onto the sheet P, which is conveyed from the paper feeding cassette 1*a*, from the intermediate transfer belt 11 by the secondary transfer section 6. The color image is formed on the sheet P.

Thereafter, the sheet P is conveyed to the fixing section 7 from the intermediate transfer belt 11. Fixing process is applied to the sheet P in a nip section formed by press contact of a heating roller 7*a* and a pressurizing roller 7*b*. A heater (not shown in the figure) is incorporated in the heating roller 7*a*. The heater is controlled to generate a predetermined temperature necessary for the fixing. After being subjected to the fixing by the fixing section 7, the sheet P is discharged to the discharge tray 9 through the discharge conveying path 8.

The configuration of the image forming section 50, which is a main component of the image forming apparatus 1, is explained in detail. The image forming section 50 includes the belt conveying section 4, the image forming units 5 including developing devices 56, and an intermediate transfer cleaning unit 45.

The belt conveying section 4 includes the driving roller 41, a driven roller 42, and an endless intermediate transfer belt 11 laid over the two rollers. The intermediate transfer belt 11 is kept at appropriate tension by a tension roller 44.

The image forming units 5Y, 5C, 5M, and 5Bk are arranged side by side below the belt conveying section 4. The image forming units 5Y, 5C, 5M, and 5Bk respectively include not-shown toner tanks configured to store toners of the colors corresponding thereto. The image forming units 5 are image forming units having substantially the same configurations except that the colors of the toners stored in the toner tanks are different.

The image forming unit 5 includes the photosensitive drum 51, a main charging device 52, an exposing device 53, a primary transfer roller 54, a cleaning device 55, and the developing device 56. The image forming unit 5 is attached to the apparatus main body 2. The photosensitive drum 51 is charged by the main charging device 52 such that dark potential in a developing position reaches predetermined potential.

The developing device 56 applies toner particles, which are supplied from the not-shown toner tank, to the surface of a developing roller 57 and supplies the toner particles to the photosensitive drum 51 from the developing roller 57 to thereby develop a toner image on the photosensitive drum 51. The toner on the photosensitive drum 51 not transferred onto the intermediate transfer belt 11 is removed by the cleaning device 55.

Subsequently, the photosensitive drum 51 is subjected to charge removal by a charge removing lamp 58 in order to reduce and equalize residual potential on the surface of the photosensitive drum 51. The photosensitive drum 51 is prepared for the next series of processes. As explained above, the image forming apparatus 1 develops, in the image forming units 5, images corresponding to black, magenta, cyan, and yellow on the photosensitive drum 51 and sequentially repeatedly multiply transfer the images onto the intermediate transfer belt 11 without deviation to form one color image.

The intermediate transfer cleaning unit 45 includes a brush roller 45*a*, a cleaning blade 45*b*, a conveying screw 45*c*, and a casing 45*d* configured to house these members. Waste toner adhering to the circumferential surface of the intermediate transfer belt 11 is scraped off by the brush roller 45*a* and the cleaning blade 45*b*.

The waste toner scraped off by the brush roller 45*a* and the cleaning blade 45*b* is accumulated in the bottom of the casing 45*d*. The conveying screw 45*c* conveys the waste toner accumulated in the bottom of the casing 45*d* to the toner container 21.

Figure 5:
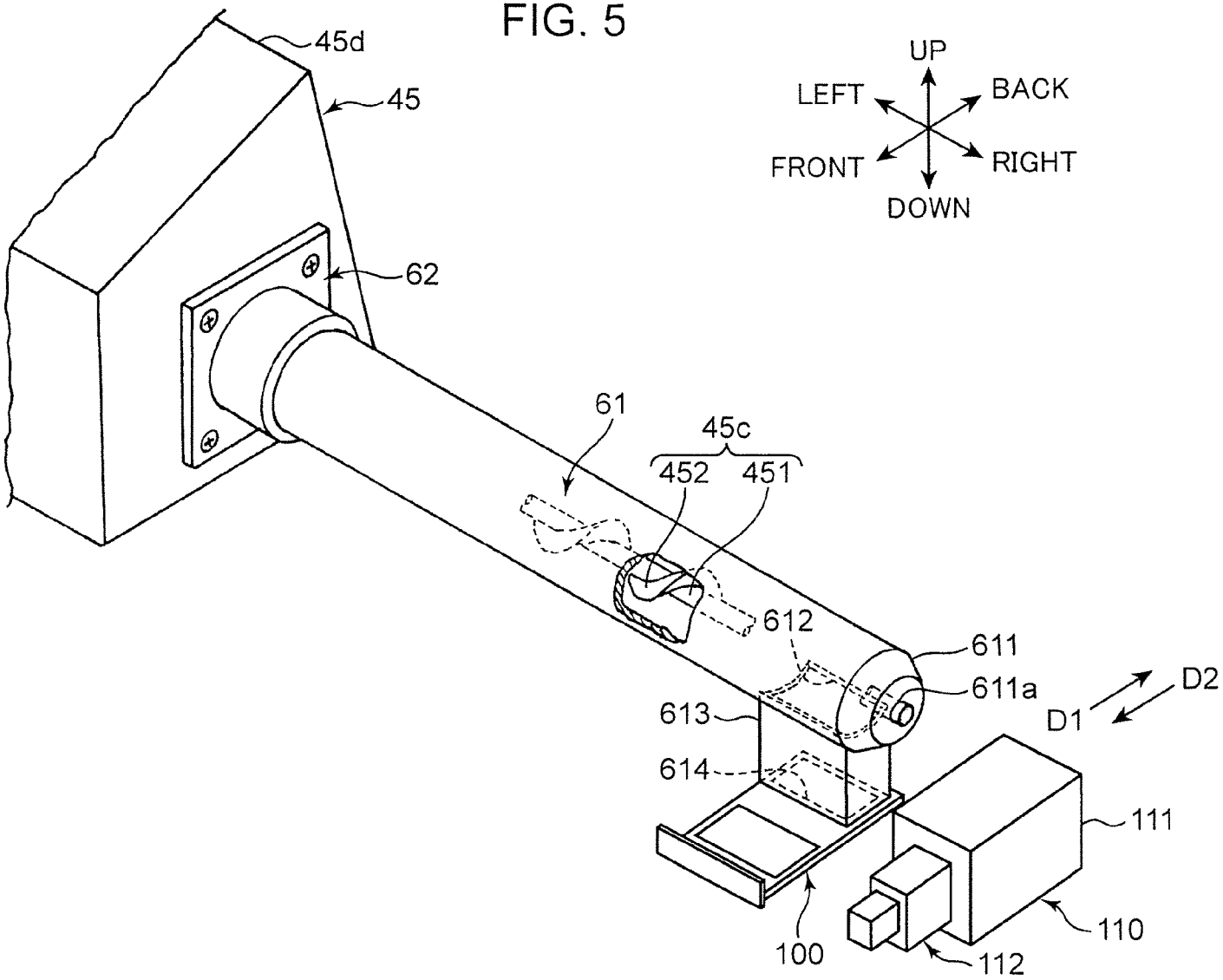
FIG. 5 is a partially cut-off perspective view showing a conveying path for conveying waste toner from an intermediate transfer cleaning section to a toner container.

A conveying path for conveying the waste toner from the intermediate transfer cleaning unit 45 to the toner container 21 is explained with reference to FIG. 5.

A fixed seat 62 for attaching a waste toner discharge pipe 61 is attached below the right side wall of the casing 45*d*. The waste toner discharge pipe 61 extended from the right side wall of the casing 45*d* to the toner container 21 is attached to the casing 45*d* by the fixed seat 62.

In the waste toner discharge pipe 61, a toner conveying path extending from the intermediate transfer cleaning unit 45 to the toner container 21 is formed. The conveying screw 45*c* is disposed in the toner conveying path. The waste toner in the casing 45*d* is conveyed to the toner container 21 by rotation about an axis of the conveying screw 45*c*.

The conveying screw 45*c* is extended from the inside of the casing 45*d* to the inside of the waste toner discharge pipe 61. The conveying screw 45*c* includes a screw shaft 451 and a spiral fin 452 formed concentrically with the screw shaft 451.

A conical section 611 concentrically formed to be tapered is formed at the distal end portion (the right end portion) of the waste toner discharge pipe 61. In an axis position of the conical section 611, a center hole 611*a*, in which one end of the screw shaft 451 is fit to support the screw shaft 451, is drilled. The other end of the screw shaft 451 is rotatably supported by a not-shown support member near the left end of the internal space of the casing 45*d*.

The screw shaft 451 is driven to rotate by a not-shown motor. When the screw shaft 451 is driven to rotate, the screw shaft 451 and the spiral fin 452 integrally rotate, whereby the waste toner in the casing 45*d* is sent to the waste toner discharge pipe 61 by the spiral fin 452. The waste toner is conveyed to the right in the waste toner discharge pipe 61.

A discharge port 612 opening downward is formed near the distal end of the waste toner discharge pipe 61. A tubular conduit 613 projected downward from the peripheral edge portion of the discharge port 612 is attached to the waste toner discharge pipe 61. A lower end opening section 614 of the conduit 613 is arranged to be opposed to the opening section 210 (FIGS. 7A and 7B) of the toner container 21. Consequently, the waste toner conveyed through the waste toner discharge pipe 61 by the spiral fin 452 drops to the opening section 210 of the toner container 21 from the discharge port 612 via the conduit 613. The waste toner is stored in the toner container 21.

A shutter member 100 is slidably disposed between the lower end opening section 614 and the opening section 210. A power switch 110 is disposed on the right side of the shutter member 100. The power switch 110 includes a switch main body section 111 having a substantially parallelepiped shape and a protrusion section 112 (a switch piece).

The protrusion section 112 can change a posture between a projecting posture in which the protrusion section 112 projects from the switch main body section 111 with a forward urging force (an urging force in a second direction D2) and a retracting posture in which the protrusion section 112 receives a backward pressing force (a pressing force in a first direction Dl) and retracts in the switch main body section 111. A not-shown opening and closing switch is housed in the switch main body section 111. The power switch 110 turns off a power supply of the image forming apparatus 1 when the protrusion section 112 takes the projecting posture and turns on the power supply of the image forming apparatus 1 when the protrusion section 112 takes in the retracting posture.

Figure 6A:
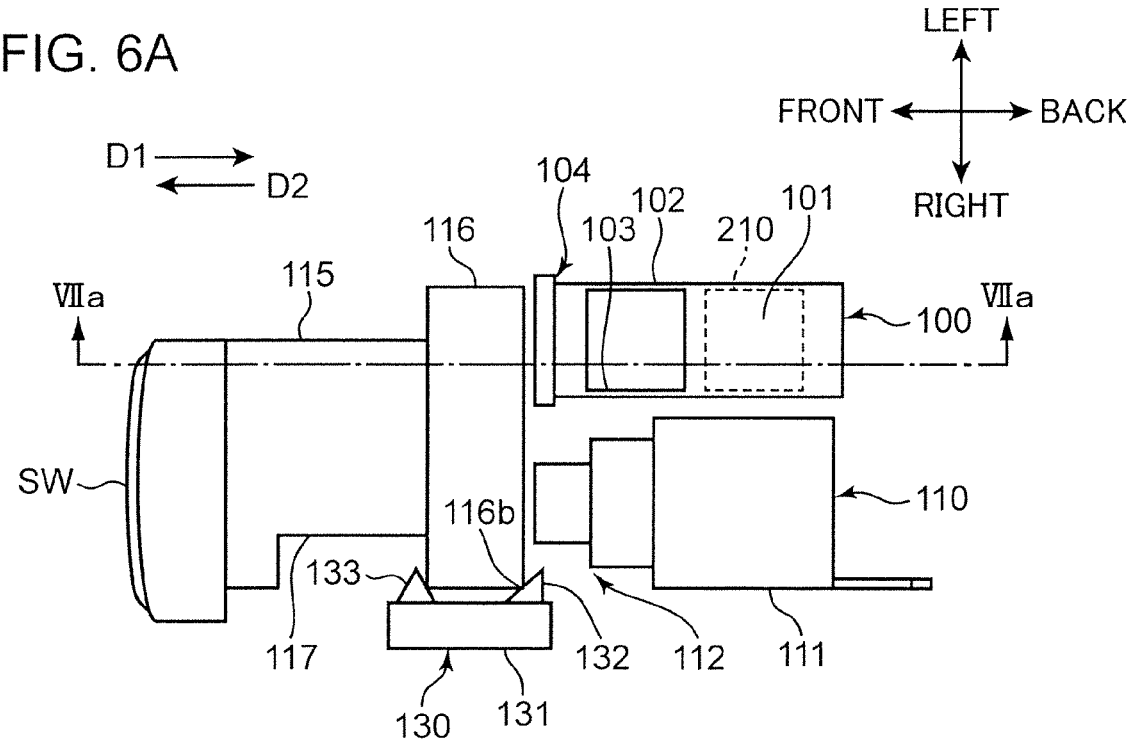
FIGS. 6A and 6B are top views of the power button, a shutter member, and a power switch.
Figure 6B:
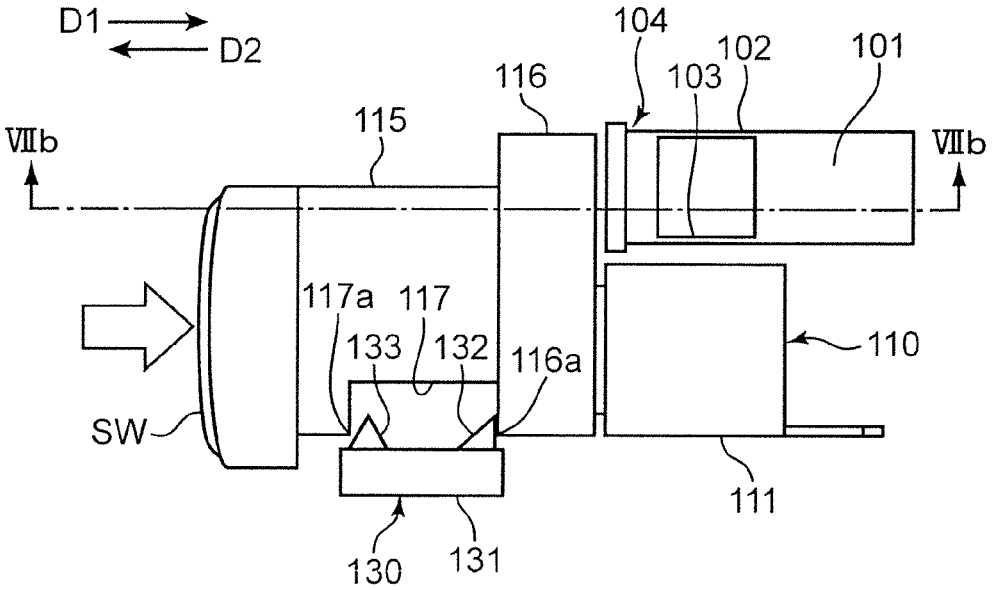
Figure 7A:
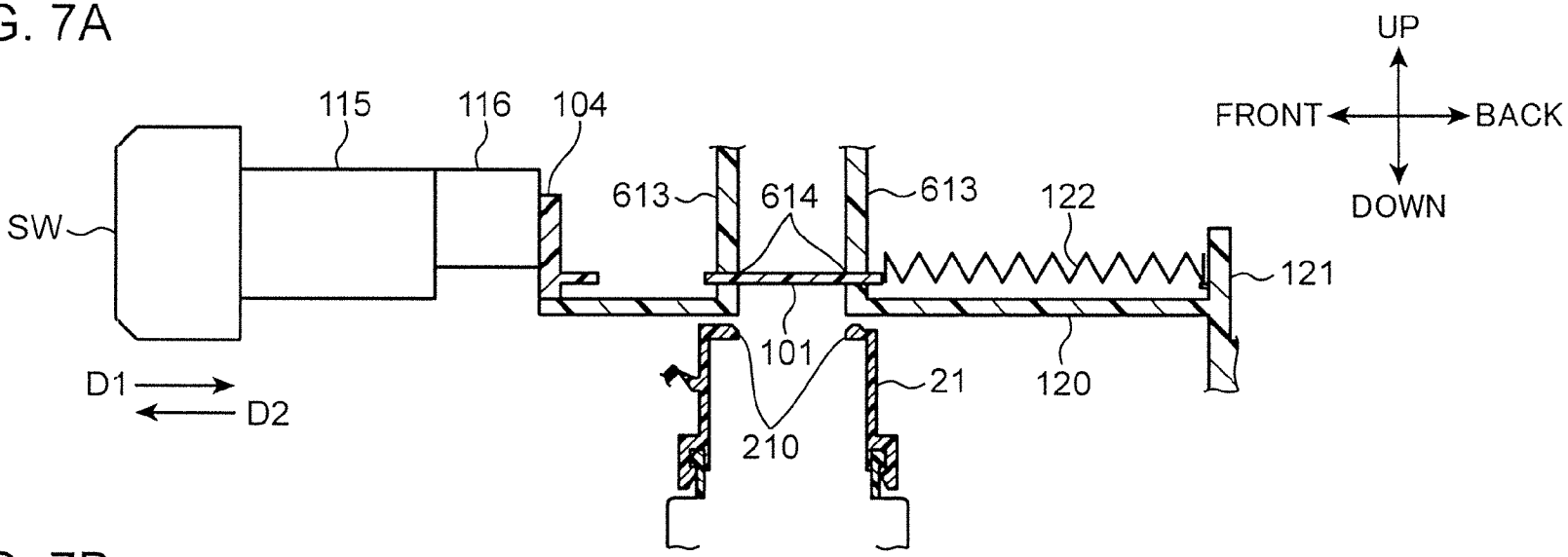
FIG. 7A is a VIIa-VIIa line sectional view of FIG. 6A.
Figure 7B:
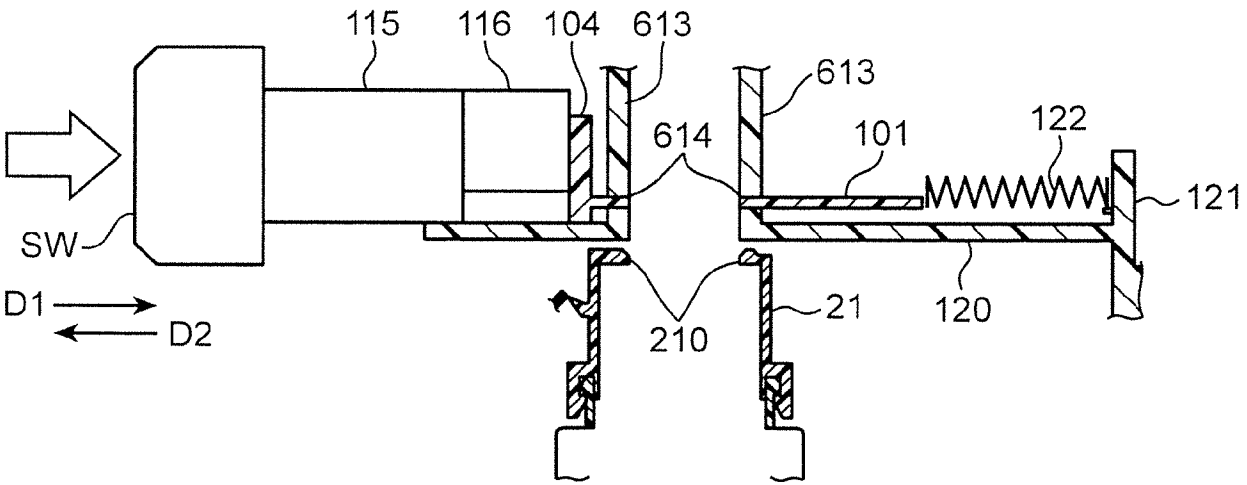
FIG. 7B is a VIIb-VIIb line sectional view of FIG. 6B.

FIG. 6A is a top view of the power button SW in the OFF posture in which the power button SW is not pressed. FIG. 6B is a top view of the power button SW in the ON posture in which the power button SW is pressed. FIG. 7A is a VIIa-VIIa line sectional view of FIG. 6A. FIG. 7B is a VIIb-VIIb line sectional view of FIG. 6B.

The shutter member 100 includes a tabular shutter 101, a coupling member 102 extended forward from the left end portion of the shutter 101, a coupling member 103 extended forward from the right end portion of the shutter 101, and a contact member 104 (a first contact member) laid at end portions of the coupling members 102 and 103. The shutter member 100 is supported slidably in the front back direction by the supporting member 120 extended to the front and the back below the shutter member 100. Consequently, the shutter member 100 can take an opening posture for opening the opening section 210 of the toner container 21 and a closing posture for closing the opening section 210. An opening is provided between the pair of coupling members 102 and 103. The opening has a size corresponding to the opening section 210. The opening is defined by the front end edge of the shutter 101, the coupling members 102 and 103 and the rear end edges of contact member 104.

An engaging section 121 projecting upward is protrudingly provided at the rear end portion of the supporting member 120. One end of a coil spring 122 (an urging member) is engaged with the engaging section 121. The other end of the coil spring 122 is set in contact with the rear end portion of the shutter 101.

A contact member 116 (a second contact member) set in contact with the contact member 104 is arranged behind the power button SW. The power button SW and the contact member 116 are coupled by a coupling member 115. The power button SW, the coupling member 115, and the contact member 116 are integrally retained slidably in the front back direction by a not-shown retaining member.

The coupling members 102 and 103, the contact members 104 and 116, and the coupling member 115 configure an example of a transmitting member. The transmitting member, the coil spring 122, and a latch mechanism 130 explained below configure an example of an interlocking mechanism. A cutout section 117 cut out to the left is formed on the right side surface of the coupling member 115.

When the power button SW is in the OFF posture (FIG. 6A), a latch mechanism 130 is located on the right side of the contact member 116. The latch mechanism 130 includes a substantially box-like latch mechanism main body section 131 and an engaging projecting piece 132 and a disengaging projecting piece 133 that project from the latch mechanism main body section 131 with a leftward urging force.

The engaging projecting piece 132 has a wedge-like shape including, on the front side, an inclined surface inclined with respect to a slide direction of the power button SW and including, on the rear side, an engaging surface substantially perpendicular to the slide direction of the power button SW. The disengaging projecting piece 133 is arranged in the front of the engaging projecting piece 132. The disengaging projecting piece 133 has a wedge-like shape including surfaces on the front side and the rear side inclined with respect to the slide direction of the power button SW.

The engaging projecting piece 132 and the disengaging projecting piece 133 interlock with each other and change a posture between an engaging posture in which the engaging projecting piece 132 and the disengaging projecting piece 133 project to the contact member 116 side (the left) with an urging force and a disengaging posture in which the engaging projecting piece 132 and the disengaging projecting piece 133 retract in a direction away from the contact member 116 (the right) resisting an urging force.

The engaging projecting piece 132 and the disengaging projecting piece 133 are located in positions opposed to the cutout section 117 when the power button SW takes the ON posture (FIG. 6B). When the power button SW takes the ON posture, the engaging projecting piece 132 and the disengaging projecting piece 133 project to the coupling member 115 side (the left) to fit in the cutout section 117 and take the engaging posture. When the engaging projecting piece 132 takes the engaging posture, the engaging surface on the rear side of the engaging projecting piece 132 engages with a corner section 116*a* at the right front end of the contact member 116. The contact member 116 is retained in a position corresponding to the ON posture of the power button SW. The power button SW is retained in the ON posture (an ON position).

The shutter member 100 is urged to the front by the coil spring 122. When the power button SW is not pressed and takes the OFF posture, the shutter 101 takes the closing posture for closing the opening section 210 in the upper part of the toner container 21 (FIGS. 6A and 7A).

A forward urging force by the coil spring 122 is transmitted to the power button SW via the shutter 101, the coupling members 102 and 103, the contact member 104, the contact member 116, and the coupling member 115. The power button SW is located in an OFF position corresponding to the OFF posture (FIG. 6A).

In this case, the contact member 116 moves forward, whereby a pressing force applied to the protrusion section 112 by the contact member 116 is released and the protrusion section 112 takes the projecting posture. According to the posture change of the protrusion section 112, the power switch 110 turns off the power supply of the image forming apparatus 1.

On the other hand, when the user presses the power button SW in the OFF posture, the power button SW slides backward from the OFF position to the ON position. A driving force caused by the sliding is transmitted to the contact member 104 and the protrusion section 112 via the coupling member 115 and the contact member 116.

When the power button SW takes the OFF posture (FIG. 6A), the engaging projecting piece 132 projects to the left on the rear side of the contact member 116. When the contact member 116 moves backward, a corner section 116*b* at the right rear end of the contact member 116 comes into contact with the inclined surface on the front side of the engaging projecting piece 132. According to the backward movement of the contact member 116, the corner section 116*b* pushes the engaging projecting piece 132 in the direction away from the contact member 116 (the right) while sliding on the inclined surface on the front side of the engaging projecting piece 132, whereby the engaging projecting piece 132 retracts. Consequently, the sliding of the power button SW to the rear side is not prevented by the latch mechanism 130.

The driving force transmitted from the contact member 116 to the contact member 104 is transmitted to the shutter 101 via the coupling members 102 and 103. The shutter 101 slides backward from the closing posture. According to the movement, the shutter 101 takes the opening posture in which the shutter 101 is located in a position retracted from the opening section 210 of the toner container 21 (FIGS. 6B and 7B). That is, the opening between the pair of coupling members 102 and 103 is opposed to the opening section 210.

On the other hand, with the driving force transmitted from the contact member 116 to the protrusion section 112, the protrusion section 112 receives a backward pressing force and takes the retracting posture. As a result, the power supply of the image forming apparatus 1 is turned on by the power switch 110.

When the power button SW is located in the ON position, the contact member 116 is located further backward than the engaging projecting piece 132. Since the cutout section 117 is located on the coupling member 115 side (the left) of the engaging projecting piece 132, a space is opened on the coupling member 115 side of the engaging projecting piece 132. As a result, nothing prevents the projection of the engaging projecting piece 132. The engaging projecting piece 132 projects to fit in the cutout section 117 and takes the engaging posture. When the engaging projecting piece 132 takes the engaging posture, the engaging surface on the rear side of the engaging projecting piece 132 engages with the corner section 116*a* of the contact member 116. The contact member 116 is retained in the ON position resisting the urging force by the coil spring 122. Therefore, even after the user releases the hand from the power button SW, the power button SW is retained in the ON position. As a result, the power supply of the image forming apparatus 1 is maintained ON. The shutter 101 is maintained in the opening posture.

Consequently, in a period in which the power supply of the image forming apparatus 1 is turned on and the image forming apparatus 1 is set operable, the shutter 101 takes the opening posture and the opening section 210 of the toner container 21 is opened. As a result, in the period in which the image forming apparatus 1 is set operable, the waste toner conveyed from the intermediate transfer cleaning unit 45 by the conveying screw 45*c* can be stored in the toner container 21.

On the other hand, when the user presses the power button SW that takes the ON posture and is located in the ON position, a front edge corner section 117*a* of the cutout section 117 moves backward and comes into contact with the inclined surface on the front side of the disengaging projecting piece 133. According to the movement, the front edge corner section 117*a* pushes the disengaging projecting piece 133 in the direction away from the contact member 116 while sliding on the inclined surface on the front side of the disengaging projecting piece 133, whereby the disengaging projecting piece 133 retracts to the right. According to the retraction of the disengaging projecting piece 133, the engaging projecting piece 132 retracts in the direction away from the contact member 116. The engaging projecting piece 132 and the contact member 116 are disengaged.

When the engaging projecting piece 132 and the contact member 116 are disengaged, the shutter member 100 slides forward with the urging force of the coil spring 122. The driving force of the shutter member 100 is transmitted to the contact member 116. The driving force transmitted to the contact member 116 is transmitted to the power button SW via the coupling member 115. The contact member 116, the coupling member 115, and the power button SW slide forward. The power button SW is located in the OFF position and takes the OFF posture.

When the contact member 116 moves forward, the pressing force on the protrusion section 112 by the contact member 116 is released and the protrusion section 112 takes the projecting posture. Consequently, the power switch 110 turns off the power supply of the image forming apparatus 1.

When the power button SW takes the OFF posture, the shutter 101 takes the closing posture for closing the opening section 210 in the upper part of the toner container 21 (FIGS. 6A and 7A). Consequently, the waste toner is prevented from leaking from the toner container 21.

When the user transports or moves the image forming apparatus 1, usually, the user turns off the power supply of the image forming apparatus 1. Therefore, when vibration is applied to the image forming apparatus 1 by the transportation or the movement of the image forming apparatus 1, the user operates the power button SW and sets the power button SW in the OFF posture. Consequently, even if the user is not aware of the leak of the waste toner, the opening section 210 of the toner container 21 is automatically closed by the shutter 101. As a result, it is possible to make it less likely that the toner leaks from the toner container 21 because of the vibration applied to the image forming apparatus 1 when the user transports or moves the image forming apparatus 1.

The power button SW is disposed on the front surface side of the apparatus main body 2. The toner container 21 is disposed below the power button SW to be detachably attachable to the apparatus main body 2. Therefore, the user can easily operate the power button SW from the front surface side of the image forming apparatus 1 and detach the toner container 21 from the apparatus main body 2 and discard the waste toner accumulated in the toner container 21. Further, the power button SW and the toner container 21 can be arranged close to each other.

When the power button SW and the toner container 21 are arranged close to each other, a distance for transmitting a change in the posture of the power button SW to the shutter 101 using the transmitting member is reduced. Therefore, it is easy to simplify the configuration of the transmitting member.

Since the toner container 21 is disposed below the power button SW, it is possible to arrange the opening section 210 of the toner container 21 to face upward and drop the waste toner to the opening section 210 from above. Therefore, it is possible to store the waste toner in the toner container 21 with a simple configuration. In this case, since the opening section 210 can be arranged to face upward, it is possible to switch the closing and the opening of the opening section 210 with a simple interlocking operation for sliding the shutter 101 in a direction same as the pressing direction of the power button SW. As a result, it is easy to simplify the interlocking mechanism.

The power button SW is illustrated as the operation member for turning on and off the power supply. However, the operation member is not limited to a push button switch. For example, as the operation member, operation switches other than the push button switch such as a seesaw switch (a locker switch) and a rotary switch may be used.

In the example explained above, by using the coupling member 115, the contact members 116 and 104, and the coupling members 102 and 103 used as the interlocking mechanism, the sliding of the power button SW is directly transmitted to the shutter 101 to slide the shutter 101. Instead, for example, by using a gear mechanism or a link mechanism as the interlocking mechanism, the motion of the operation member may be converted into another motion and transmitted to the shutter.

For example, when the seesaw switch is used as the operation member, the link mechanism can expand a small motion of the seesaw switch with the principle of a lever and transmit the motion to the shutter. Therefore, the link mechanism is suitable as the interlocking mechanism when the seesaw switch is used as the operation member. For example, when the rotary switch is used as the operation member, by using the gear mechanism such as a rack and pinion as the interlocking mechanism, it is easy to convert a rotary motion of the rotary switch into a sliding motion. Therefore, the gear mechanism is suitable as the interlocking mechanism when the seesaw switch is used as the operation member.

In the example explained above, the posture of the shutter is changed between the opening posture and the closing posture by the sliding. However, the shutter is not limited to the sliding shutter. For example, a shutter configured by forming an opening section substantially the same as the opening section 210 in a disc-like member can be used. By rotating the disc-like shutter in association with the motion of the operation member, it is possible to change the posture of the shutter between the opening posture in which the opening section of the shutter is located in the position opposed to the opening section 210 and the closing posture in which the a disc portion without the opening section is located in the position opposed to the opening section 210.

As an example of the toner container, the toner container configured to store the waste toner collected by the cleaning device is illustrated. However, the toner container may be a toner tank configured to store new toner. The shutter may be disposed to open and close an opening section of the toner tank for supplying the toner from the toner tank to the developing device.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus comprising:

an apparatus main body configured to form an image on a sheet using toner;

an operation member for turning on and off a power supply of the apparatus main body according to operation by a user, the operation member being capable of taking an ON posture for turning on the power supply and an OFF posture for turning off the power supply, the OFF posture being a posture in which the operation member is in a predetermined OFF position, and the ON posture being a posture in which the operation member is located in an ON position separated from the OFF position, the operation member being a push button configured to slide in a first direction extending from the OFF position to the ON position according to a pressing operation by the user;

a toner container configured to store the toner and including an opening section configured to allow communication between an inside and an outside of the container;

a shutter capable of taking an opening posture for opening the opening section and a closing posture for closing the opening section; and an interlocking mechanism configured to interlock the posture of the operation member and the posture of the shutter to set the shutter in the opening posture when the operation member takes the ON posture and to set the shutter in the closing posture when the operation member takes the OFF posture, the interlocking mechanism setting the shutter in the closing posture by locating the shutter in a position opposed to the opening section when the operation member is in the OFF position, the interlocking mechanism transmitting a driving force to the shutter caused by sliding the operation member from the OFF position to the ON position, and locating the shutter in a position retracted from the opening section to thereby set the shutter in the opening posture.

2. The image forming apparatus according to claim 1, wherein the interlocking mechanism includes:

an urging member configured to urge the shutter to a second direction opposite to the first direction;

a transmitting member configured to transmit a driving force of the operation member in the first direction to the shutter and transmit a driving force of the shutter in the second direction to the operation member; and a latch mechanism configured to retain the operation member in the ON posture and release the retention when the operation member in the ON posture is pressed in the first direction, wherein when the retention by the latch mechanism is released, the shutter slides from the retracted position to the closing posture along the second direction with an urging force of the urging member, and the transmitting member transmits a driving force caused by the sliding of the shutter along the second direction to the operation member to thereby slide the operation member to the OFF position.

3. The image forming apparatus according to claim 2, further comprising a power switch including:

a switch main body section disposed in a position separated from the ON position in the first direction; and a protrusion section configured to be capable of taking a projecting posture in which the protrusion section projects from the switch main body section with an urging force along the second direction, and a retracting posture in which the protrusion section receives a driving force in the first direction from the transmitting member and retracts into the switch main body section, wherein the power switch turns off the power supply of the image forming apparatus when the protrusion section takes the projecting posture and turns on the power supply of the image forming apparatus when the protrusion section takes the retracting posture, and the transmitting member further transmits the driving force of the operation member in the first direction to the protrusion section.

4. The image forming apparatus according to claim 1, wherein the shutter includes an opening having a size corresponding to the opening section, and a first contact member, the interlocking mechanism includes a second contact member configured to move integrally with the operation member and to come into contact with the first contact member, and the opening posture is formed when the second contact member presses the first contact member to move the shutter such that the opening of the shutter is located on the opening section.

5. The image forming apparatus according to claim 1, further comprising a power switch including a projecting and retracting switching piece and configured to turn on and off the power supply of the image forming apparatus, wherein the shutter includes an opening having a size corresponding to the opening section, and a first contact member, the interlocking mechanism includes a second contact member configured to move integrally with the operation member and to come into contact with the first contact member, and when the operation member takes the ON posture, the second contact member presses the first contact member and the switch piece to set the shutter in the opening posture and cause the power switch to turn on the power supply.

6. An image forming apparatus comprising:

an apparatus main body configured to form an image on a sheet using toner;

an operation member for turning on and off a power supply of the apparatus main body according to operation by a user, the operation member being capable of taking an ON posture for turning on the power supply and an OFF posture for turning off the power supply;

a toner container configured to store the toner and including an opening section configured to allow communication between an inside and an outside of the container;

a shutter capable of taking an opening posture for opening the opening section and a closing posture for closing the opening section; and an interlocking mechanism configured to interlock the posture of the operation member and the posture of the shutter to set the shutter in the opening posture when the operation member takes the ON posture and to set the shutter in the closing posture when the operation member takes the OFF posture, wherein the operation member is disposed on a front surface side of the apparatus main body, and the toner container is disposed below the operation member to be detachably attachable to the apparatus main body.

7. The image forming apparatus according to claim 6, wherein the OFF posture is a posture in which the operation member is located in a predetermined OFF position, the ON posture is a posture in which the operation member is located in an ON position separated from the OFF position, the operation member is a push button configured to slide in a first direction extending from the OFF position to the ON position according to pressing operation by the user, and the interlocking mechanism sets the shutter in the closing posture by locating the shutter in a position opposed to the opening section when the operation member is located in the OFF position, transmits a driving force caused by the sliding of the operation member from the OFF position to the ON position to the shutter, and locates the shutter in a position retracted from the opening section to thereby set the shutter in the opening posture.

* * * * *